US010342730B2

(12) United States Patent
Malhi

(10) Patent No.: US 10,342,730 B2
(45) Date of Patent: Jul. 9, 2019

(54) COMPRESSION GARMENT HAVING SEALABLE BLADDER POCKET

(71) Applicant: KPR U.S., LLC, Mansfield, MA (US)

(72) Inventor: Arnaz Malhi, Watertown, MA (US)

(73) Assignee: KPR U.S., LLC, Mansfield, MA (US)

( * ) Notice: Subject to any disclaimer, the term of this patent is extended or adjusted under 35 U.S.C. 154(b) by 0 days.

(21) Appl. No.: 15/192,655

(22) Filed: Jun. 24, 2016

(65) Prior Publication Data

US 2016/0374891 A1 Dec. 29, 2016

Related U.S. Application Data

(63) Continuation of application No. 13/248,390, filed on Sep. 29, 2011, now abandoned.

(51) Int. Cl.
*A61H 9/00* (2006.01)

(52) U.S. Cl.
CPC ... *A61H 9/0092* (2013.01); *A61H 2201/0107* (2013.01); *A61H 2201/165* (2013.01); *A61H 2205/06* (2013.01); *A61H 2205/10* (2013.01); *A61H 2209/00* (2013.01)

(58) Field of Classification Search
CPC .... A61H 9/005; A61H 9/0078; A61H 9/0092; A61H 2205/06; A61H 2205/10; A61H 2205/102; A61H 2205/104; A61H 2205/106; A61H 2205/108; A61H 2209/00; A61H 2011/005; A61H 2201/103; A61H 2201/107; A61H 2201/111
See application file for complete search history.

(56) References Cited

U.S. PATENT DOCUMENTS

| | | | | |
|---|---|---|---|---|
| 3,473,525 | A | 10/1969 | Hanafin | |
| 3,570,495 | A | 3/1971 | Wright | |
| 4,027,666 | A | 6/1977 | Marx | |
| 4,033,337 | A | 7/1977 | Raczkowski | |
| 4,054,129 | A | 10/1977 | Byars et al. | |
| 4,682,793 | A * | 7/1987 | Walz | B41L 1/26 229/300 |
| 4,781,189 | A | 11/1988 | Vijil-Rosales | |
| 4,872,448 | A | 10/1989 | Johnson, Jr. | |

(Continued)

OTHER PUBLICATIONS

Office Action dated Sep. 5, 2013 in related Korean Application No. 10-2012-108750, 5 pages.

(Continued)

*Primary Examiner* — Michael J Tsai
(74) *Attorney, Agent, or Firm* — Jacob R. Lenzke

(57) ABSTRACT

A compression garment having a sealable bladder pocket adapted for applying compression therapy to a selected body part of a patient. The compression garment includes a selectively inflatable bladder and a wrap having a selectively sealable pocket. The pocket has a sealable main opening sized for passing the bladder therethrough for inserting the bladder in the pocket and removing the bladder from the pocket. A connector on the bladder may be connected to a fluid supply line via the main opening. In other embodiments, the connector may be connected in fluid communication with the fluid supply line via a secondary opening separated from the main opening. Fluid is delivered from the fluid source to an inflatable interior of the bladder to impart compression therapy to the body part.

15 Claims, 10 Drawing Sheets

(56) References Cited

U.S. PATENT DOCUMENTS

| | | | | |
|---|---|---|---|---|
| 4,993,409 | A * | 2/1991 | Grim | A61F 5/028 602/19 |
| 5,020,515 | A | 6/1991 | Mann et al. | |
| 5,062,414 | A | 11/1991 | Grim | |
| 5,193,553 | A | 3/1993 | Kalinoski | |
| 5,348,530 | A | 9/1994 | Grim et al. | |
| 5,372,575 | A | 12/1994 | Sebastian | |
| 5,385,538 | A | 1/1995 | Mann | |
| 5,437,614 | A * | 8/1995 | Grim | A61F 5/022 602/19 |
| 5,437,620 | A | 8/1995 | Shelly | |
| 5,690,672 | A | 11/1997 | Cohen | |
| 5,702,355 | A | 12/1997 | Repice et al. | |
| 5,711,760 | A | 1/1998 | Ibrahim et al. | |
| 5,732,411 | A | 3/1998 | Coleman et al. | |
| 5,797,851 | A * | 8/1998 | Byrd | A61B 5/02233 600/499 |
| 5,833,639 | A | 11/1998 | Nunes et al. | |
| 6,290,662 | B1 | 9/2001 | Morris et al. | |
| 6,427,239 | B1 | 8/2002 | Worden | |
| 6,551,249 | B2 | 4/2003 | Ashida et al. | |
| 6,589,194 | B1 | 7/2003 | Calderon et al. | |
| 7,008,390 | B2 | 3/2006 | Miotto et al. | |
| 7,074,177 | B2 | 7/2006 | Pickett et al. | |
| 7,276,037 | B2 | 10/2007 | Ravikumar | |
| RE40,363 | E | 6/2008 | Grim et al. | |
| 7,540,690 | B2 | 6/2009 | Garcia et al. | |
| 7,618,384 | B2 | 11/2009 | Nardi et al. | |
| 7,727,174 | B2 | 6/2010 | Chang et al. | |
| 8,460,224 | B2 * | 6/2013 | Wilford | A61H 9/00 601/151 |
| 2002/0115949 | A1 | 8/2002 | Kuslich et al. | |
| 2003/0225347 | A1 * | 12/2003 | Argenta | A61B 17/88 601/6 |
| 2004/0039317 | A1 | 2/2004 | Souney et al. | |
| 2004/0111048 | A1 | 6/2004 | Jensen et al. | |
| 2005/0256556 | A1 | 11/2005 | Schirrmacher et al. | |
| 2007/0088235 | A1 | 4/2007 | Tseng | |
| 2007/0100266 | A1 | 5/2007 | Hargrave et al. | |
| 2007/0282230 | A1 | 12/2007 | Valderrabano et al. | |
| 2008/0306420 | A1 | 12/2008 | Vess | |
| 2010/0298725 | A1 * | 11/2010 | Vivenzio | A61B 5/02233 600/490 |
| 2013/0085427 | A1 | 4/2013 | Malhi | |
| 2013/0085428 | A1 | 4/2013 | Deshpande | |

OTHER PUBLICATIONS

Office Action dated Feb. 24, 2015 in related U.S. Appl. No. 13/248,390, 14 pages.

Response dated May 22, 2015 to Office Action dated Feb. 24, 2015 in related U.S. Appl. No. 13/248,390, 14 pages.

Office Action dated Jul. 15, 2015 in related U.S. Appl. No. 13/248,390, 16 pages.

Response dated Sep. 15, 2015 to Office Action dated Jul. 15, 2015 in related U.S. Appl. No. 13/248,390, 14 pages.

Office Action dated Dec. 24, 2015 in related U.S. Appl. No. 13/248,390, 18 pages.

Response dated Mar. 22, 2016 to Office Action dated Dec. 24, 2015 in related U.S. Appl. No. 13/248,390, 14 pages.

Office Action dated Apr. 6, 2016 in related U.S. Appl. No. 13/248,390, 18 pages.

* cited by examiner

COMPRESSION GARMENT HAVING SEALABLE BLADDER POCKET

CROSS-REFERENCE TO RELATED APPLICATIONS

This application is a continuation of U.S. Ser. No. 13/248,390, filed Sep. 29, 2011, the entire content of which is incorporated herein by reference.

FIELD OF THE INVENTION

The present invention is directed generally to a compression garment for applying compression therapy to a body part of a wearer and more particularly to such a compression garment having a sealable bladder pocket.

BACKGROUND OF THE INVENTION

Among major concerns for generally immobile persons are medical conditions that form blood clots, such as deep vein thrombosis (DVT), and peripheral edema. Such patients and persons include those undergoing surgery, anesthesia, and extended periods of bed rest. These blood clotting conditions generally occur in the deep veins of the lower extremities and/or pelvis. These veins, such as the iliac, femoral, popliteal, and tibial return deoxygenated blood to the heart. For example, when blood circulation in these veins is retarded due to illness, injury, or inactivity, there is a tendency for blood to accumulate or pool. A static pool of blood may lead to the formation of a blood clot, which can interfere with cardiovascular circulation. More seriously, a fragment of the blood clot can break loose and migrate. A pulmonary embolus can form from the fragment potentially blocking a main pulmonary artery, which may be life threatening. The current invention can also be applied to the treatment of other conditions, such as lymphedema.

Conventional vascular compression systems include a compression garment fluidly connected to a controller for cyclically inflating the compression garment. The cyclical inflation of the compression garment enhances blood circulation and decreases the likelihood of DVT. A system of conduits connects the compression garment to the controller. Newer vascular compression garments have portable controllers that are much smaller and mountable on the compression garment so the patient may move about freely without having to first remove the compression garment or disconnect the compression garment from a controller. These newer compression garments may be worn when a patient is stationary or ambulatory and are believed to enhance patient compliance because of convenience of use.

In general, conventional compression garments are intended for use with a single patient. The garments are discarded after use even through portions of the garments could be reused. Conventional compression garments are constructed with an integrally formed bladder that prevents the bladder from be reused.

SUMMARY OF THE INVENTION

In one aspect, a compression garment adapted for applying compression therapy to a selected body part of a patient comprises a selectively inflatable bladder having a hollow interior. The inflatable bladder also includes an inlet connector through which fluid passes when entering the interior to inflate the bladder. The connector is connectable to a fluid supply line in communication with a fluid source for supplying fluid to the bladder. The compression garment also includes a wrap sized and shaped for wrapping around at least a portion of the selected body part. The wrap includes a fastener for fastening the wrap in position when wrapped around the body part and a pocket sized and shaped for receiving the bladder to hold the bladder against the body part when applying compression therapy. The pocket has a main opening sized for passing the bladder therethrough when inserting the bladder in the pocket and removing the bladder from the pocket and a secondary opening separated from the main opening sized, shaped, and positioned with respect to the main opening for permitting the supply line to be operatively connected to the connector when the bladder is positioned in the pocket. The main opening is selectively sealable when closed to hold the bladder in position in the pocket and prevent fluid from entering the pocket through the main opening. The pocket is formed from fluid-impermeable material to shield the bladder from the bodily fluids of the patient.

In another aspect, the present invention is directed to a method of making a garment adapted for holding a bladder on a body part of a patient for imparting compression therapy to the body part. The bladder includes an inflatable chamber and a connector in fluid communication with the inflatable chamber through which the inflatable chamber is inflated. The method comprises disposing inner and outer layers including fluid-impermeable material in stacked relationship and forming a pocket between the inner and outer layers by bonding the inner layer to the outer layer along a boundary defining an outer perimeter of the pocket. First and second segments of the inner layer are maintained free from bonding to the outer layer to define a main opening and a secondary opening between the inner and outer layers providing access to the pocket. The main opening is sized and shaped to permit the bladder to be inserted in the pocket, and the secondary opening is sized and shaped for permitting exposure of the connector on the bladder outside the pocket for connecting a source of pressurized fluid to the chamber for inflating the chamber. The method further comprises applying adhesive to at least one of the inner and outer layers adjacent the main opening and the secondary opening for adhering the inner layer to the outer layer at the respective opening to seal the respective opening to prevent bodily fluid from entering the pocket through the respective opening.

In another aspect, the present invention is directed to a compression garment adapted for applying compression therapy to a selected body part of a patient. The garment includes a selectively inflatable bladder having a hollow interior and an inlet connector through which fluid passes when entering the interior to inflate the bladder. The connector is connectable to a fluid supply line in communication with a fluid source for supplying fluid to the bladder. The garment also includes a wrap sized and shaped for wrapping around at least a portion of the selected body part. The wrap includes a fastener for fastening the wrap in position when wrapped around the body part and a pocket sized and shaped for receiving the bladder to hold the bladder against the body part when applying compression therapy. The pocket has a main opening sized for passing the bladder therethrough when inserting the bladder in the pocket and removing the bladder from the pocket. The main opening is configured for permitting the supply line to be operatively connected to the connector through the main opening when the bladder is positioned in the pocket. The main opening is selectively sealable when closed to hold the bladder in position in the pocket and prevent fluid from entering the pocket through the main opening. The pocket is formed from fluid-impermeable material to shield the bladder from bodily fluids of the patient.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
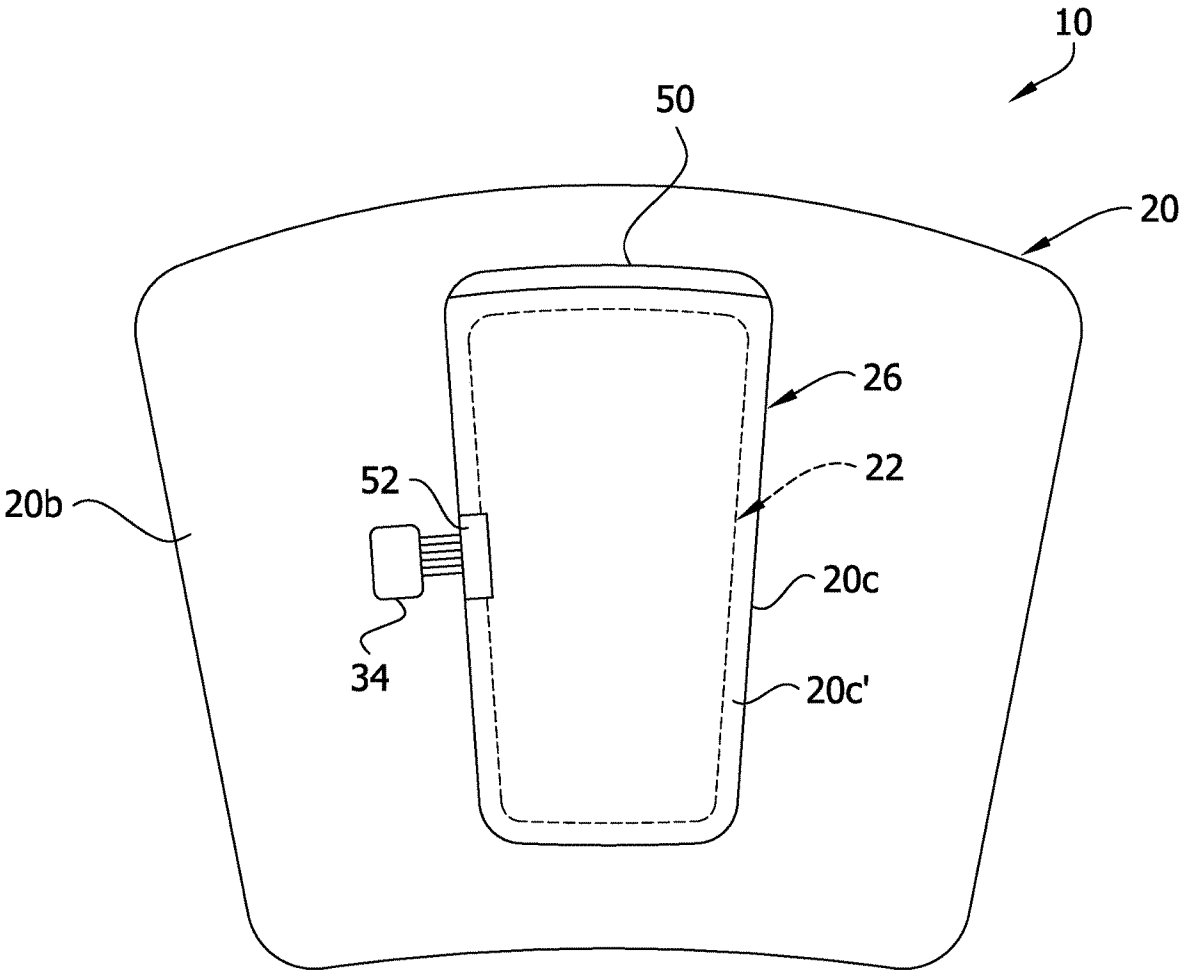
FIG. 1 is a schematic front elevation of a compression garment of the present invention shown in an open, unwrapped configuration.

Referring now to the drawings, and in particular to FIG. 1, a compression garment according to the present invention is generally indicated by the reference number 10. The compression garment 10 is used for compressing a body part such as a limb (e.g., a leg or arm). The compression garment 10 may be used to apply various types of compression therapy known in the art, such as intermittent compression therapy. The illustrated compression garment 10 is configured for application on a leg and has a "knee length" size, i.e., the compression garment extends generally from the ankle to below the knee. Other sizes and shapes of garments (e.g., "thigh length," extending generally from the ankle to the thigh). Garments may be configured for application to other body parts without departing from the scope of the present invention.

The compression garment includes a wrap, generally indicated by the reference number 20, and a selectively inflatable bladder, generally indicated by the reference number 22. The wrap 20 is sized and shaped for wrapping around at least a portion of the limb. The wrap 20 includes a pocket, generally indicated by the reference number 26, which is sized and shaped for receiving the bladder 22 to hold the bladder against the limb. The wrap may be formed using various materials. For example, the wrap may be formed using various layers of non-woven material such as polyester. In some embodiments, the wrap is formed using fluid-impermeable material for reasons which will become apparent. Other types of materials may be used without departing from the scope of the present invention.

Figure 2:
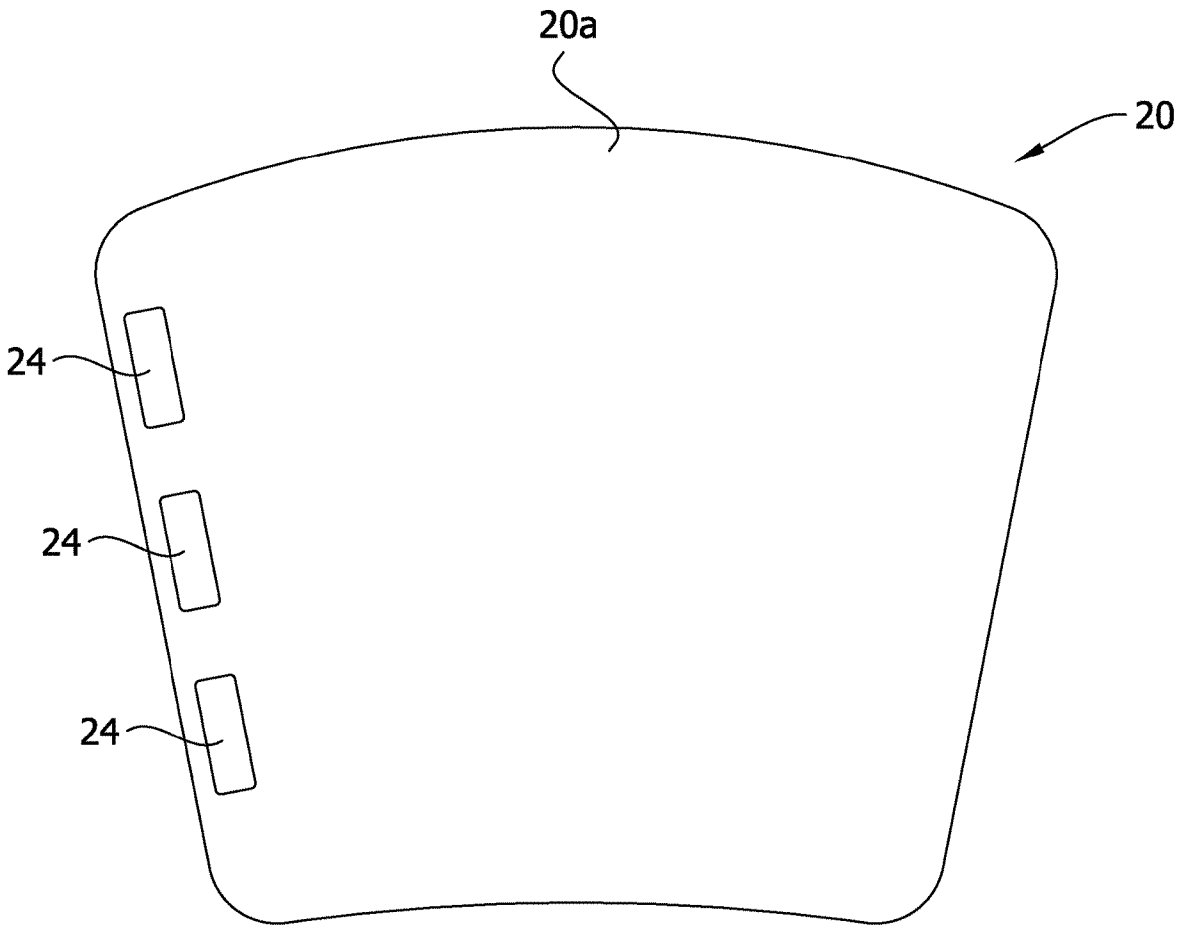
FIG. 2 is a schematic rear elevation of the compression garment.

The wrap 20 includes one or more fasteners 24 for securing the wrap in position when wrapped around the limb. For example, as shown in FIG. 2, the fasteners 24 may be hook fabric provided on an inner surface 20*a* of the wrap 20 for fastening to loop pile on an outside surface 20*b* of the wrap 20. Other types of fasteners such as snaps, buttons, clips, straps, magnets, and adhesives may be used without departing from the scope of the present invention.

Figure 3:
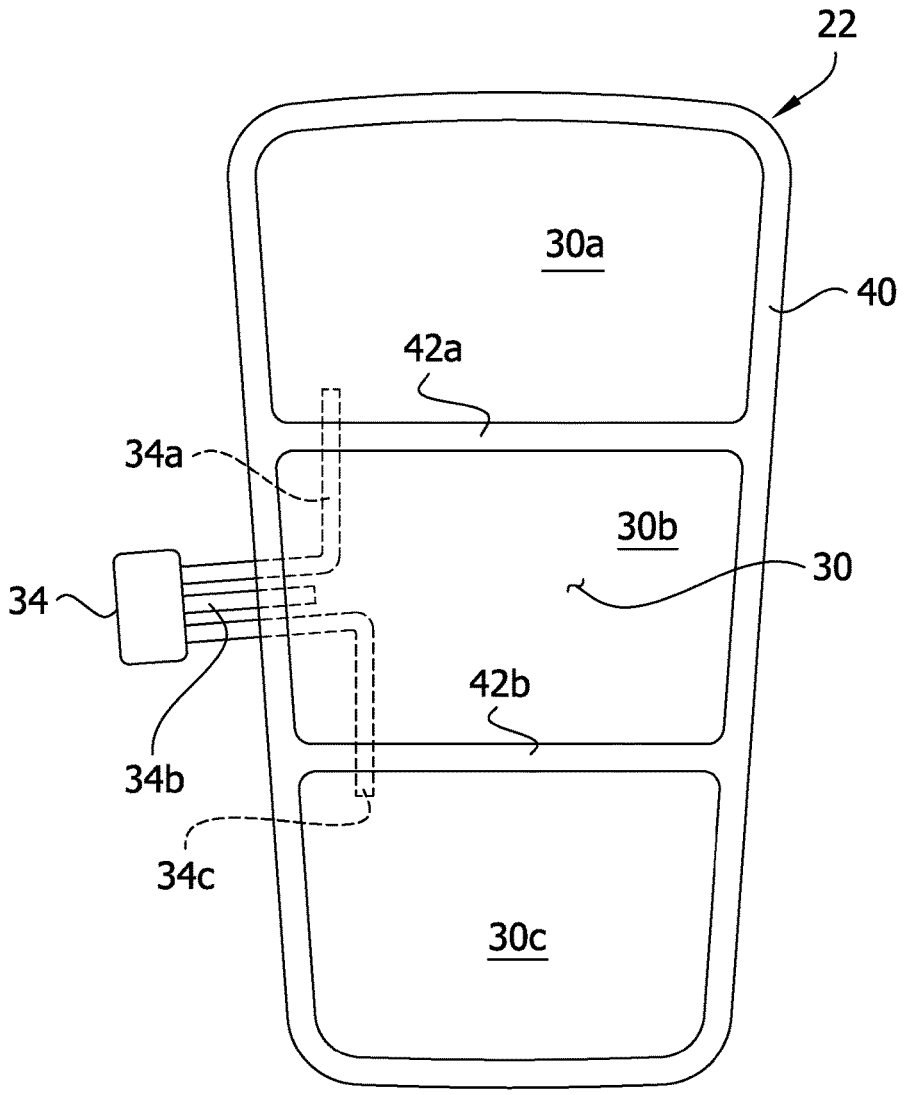
FIG. 3 is a schematic front elevation of a bladder of the compression garment.

FIG. 3 illustrates one embodiment of the bladder 22. The bladder 22 includes an inflatable hollow interior, generally indicated by the reference number 30. In the illustrated embodiment, the hollow interior 30 is divided into three chambers 30*a*, 30*b*, 30*c*. The bladder 22 includes a connector 34 in fluid communication with the three chambers 30*a*, 30*b*, 30*c*. The illustrated connector 34 includes three fluid conduits 34*a*, 34*b*, 34*c*, each in communication with respective chambers 30*a*, 30*b*, 30*c*. The connector 34 is connectable to a fluid supply line in communication with a fluid source for supplying fluid to the bladder (not shown).

The bladder 22 may be formed by joining sheets of fluid-impermeable material such as PVC in face to face relation. For example, the bladder 22 may be made using pliable PVC material having a thickness in a range from about 0.002 inches to about 0.020 inches. In one embodiment, the material may be 0.006 inches thick. The sheets may be joined by radiofrequency welding, heat welding, ultrasonic welding, or using other types of mechanical or chemical bonding processes. For example, the bladder illustrated in FIG. 3 may be formed by stacking two bladder sheets so their perimeters are generally aligned and forming a weld 40 around an edge margin to form the hollow interior 30 between the sheets. Welds 42*a*, 42*b* formed across the hollow interior 30 divide the hollow interior into the chambers 30*a*, 30*b*, 30*c*. The welds 40, 42*a*, 42*b* are formed across the fluid conduits 34*a*, 34*b*, 34*c* to seal the bladder sheets around the conduits but allow fluid communication between the chambers 30*a*, 30*b*, 30*c* and the connector 34 through the conduits. Other bladder configurations may be used without departing from the scope of the present invention. For example, the hollow interior 30 may have a different number of chambers, such as 1, 2, 4, 5, or more chambers. Moreover, different types of connectors and/or arrangements of fluid conduits may be used for connecting the hollow interior 30 in fluid communication with a fluid source (not shown).

The bladder 22 and pocket 26 are configured so the bladder may be inserted and removed from the pocket. This arrangement allows the bladder 22 to be interchangeable with other wraps and vice versa. For example, a bladder chosen for use may be selected from a variety of differently configured bladders based on the desired type of compression therapy. A single bladder may be reused in two, three, or more wraps for the same or multiple patients. Moreover, the bladders may be used in differently configured wraps. For example, a wrap may have multiple pockets, each for holding one or more bladders.

Referring again to FIG. 1, the pocket 26 includes a main opening 50 and a secondary opening 52. The main opening 50 is sized for passing the bladder 22 through it when inserting the bladder in the pocket 26 and removing the bladder from the pocket. The main opening 50 may have a length slightly longer than the width of the bladder 22 to permit the bladder to be conveniently inserted into the pocket 26. For example, the main opening 50 may be about 12, 14, 16, 18, 20, 22, 24, or more centimeters long. The secondary opening 52 is separate from the main opening 50 and is sized, shaped, and positioned with respect to the main opening for permitting the supply line to access the connector 34 when the bladder 22 is positioned in the pocket 26.

The secondary opening 52 is sized to permit at least part of the connector 34 or part of the fluid supply line to pass through the secondary opening. The secondary opening may be smaller than the main opening. For example, the secondary opening may be about 4, 6, 8, 10, 12, 14, or more centimeters long. In the illustrated embodiment, the connector 34 is shown extending outside the pocket through the secondary opening 52. Alternatively, the connector 34 may remain inside the pocket 26, and the supply line may be inserted in the pocket through the secondary opening 52. As will become apparent, such an arrangement would shield the connector 34 inside the sealable pocket 26.

As viewed in FIG. 1, the main opening 50 is provided at the upper end of the pocket 26, and the secondary opening 52 is provided at the middle of the left side of the pocket. The openings 50, 52 may have other positions without departing from the scope of the present invention. For example, the main opening 50 may be provided at the upper or lower end or the left or right side of the pocket 26. The main opening 50 is shown as being generally linear and extending across about the full length of the upper end of the pocket 26, but main openings may have other shapes and lengths without departing from the scope of the present invention. For example, the main opening 50 may extend across the upper end of the pocket 26 and partially down along one or both sides of the pocket. Moreover, the secondary opening 52 may be provided at the upper or lower end or at an upper, intermediate, or lower position along the left or right side of the pocket 26. The secondary opening 52 may be positioned to conform to relative connector locations on conventional bladders or bladders designed particularly for use with the wrap. The secondary opening 52 may be positioned so the fluid connection between the connector 34 and the fluid supply line is oriented or positioned in a desired orientation or position when the wrap is worn, such as near the front or side of the limb.

Figure 4:
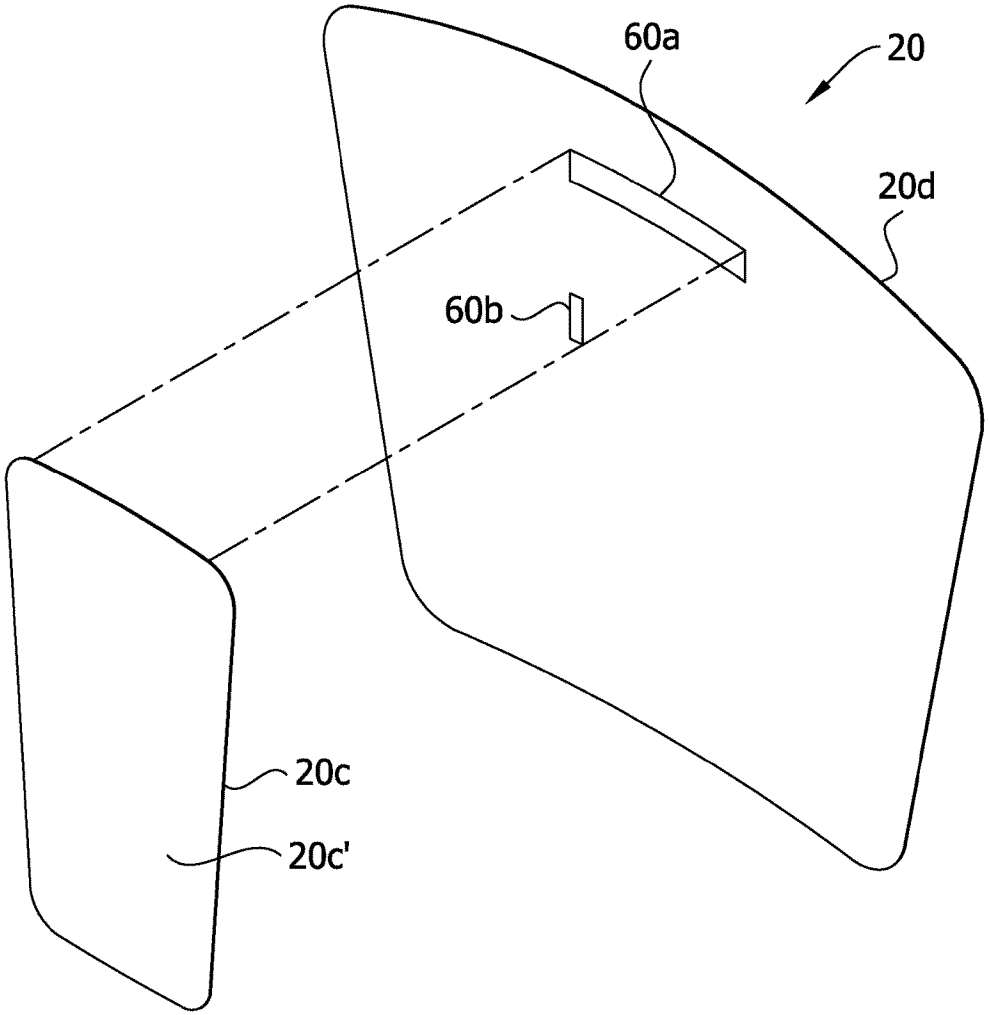
FIG. 4 is a separated perspective of a wrap of the compression garment.

The pocket 26 may be formed in a variety of ways. For example, as illustrated in FIG. 4, the pocket 26 may be formed by securing a cover (or outer layer) 20*c* to a main body (or inner layer) 20*d* of the wrap. The cover 20*c* is positioned to overlie the main body 20*d* and bonded to the main body in face-to-face relationship. Techniques such as described above with respect to the bladder 22 may be used to bond the cover 20*c* to the main body 20*d*. The cover 20*c* is bonded to the main body 20*d* around a perimeter or boundary 20*c*' of the cover to define an outer perimeter of the pocket. In some embodiments, the bond defining the outer perimeter of the pocket may be formed inboard from the perimeter of the cover 20*c*'. In other words, the cover 20*c* may have a size and shape generally different than the outer perimeter of the pocket. In the illustrated embodiment, the main and primary openings 50, 52 are located between the cover 20*c* and the main body 20*d* at segments where the cover and main body are not bonded. Other pocket configurations may be used without departing from the scope of some embodiments of the present invention. For example, a pocket may be formed between layers of the main body.

The pocket 26 is desirably constructed to shield the bladder 22 from bodily fluids and other potential sources of contamination. In other words, the pocket 26 encapsulates the bladder 22 to prevent external fluids from contacting the bladder. The pocket 26 may be formed from fluid-impermeable material to shield the bladder. For example, the cover 20*c* and main body 20*d* of the wrap 20 may comprise a fluid-impermeable non-woven material such as a PVA/polyester laminate. In addition, the main and secondary openings 50, 52 are selectively sealable when closed to hold the bladder 22 in position in the pocket 26 and prevent fluid from entering the pocket through the openings. The main and secondary openings 50, 52 may be sealed using adhesive. Various types of adhesives may be used, such as polyacrylate based adhesives (e.g., hot melt and solvent types) and polyolefin based adhesives. The adhesive may be applied by spraying, by extruding, or by applying an adhesive film adhesive. In some embodiments, adhesive may be provided on the wrap 20 adjacent the openings 50, 52 and covered with film strips 60*a*, 60*b* as shown in FIG. 4. The film strips 60*a*, 60*b* are selectively removable from the adhesive to expose the adhesive, and the openings 50, 52 are sealed by pressing the openings closed to adhere the cover 20*c* to the main body 20*d* at the openings. In some embodiments, the main opening 50 is completely sealable to prevent fluid from entering the main opening. In some embodiments, the secondary opening 52 is also desirably sealable around the connector 34 or the fluid line in communication with the connector. Thus, fluid from the fluid source may flow through the connector 34 into the hollow interior 30 via the fluid conduits 34*a*, 34*b*, 34*c*, but other fluid outside the conduits such as spilled beverage or bodily fluid is prevented from entering the pocket 26 through the sealed secondary opening 52. In the illustrated embodiment, the film-covered adhesive 60*a*, 60*b* adjacent both openings is provided on the main body of the wrap 20*d*. Alternatively, the adhesive may be positioned on the cover 20*c* or not provided on the wrap 20. Other methods of sealing the main and secondary openings 50, 52 may be used without departing from the scope of the present invention.

To use the compression garment 10, a health care provider administers compression therapy to a body part by selecting a wrap and bladder configured for the desired type of compression therapy. For example, the bladder 22 is inserted in the pocket 26 of the wrap 20 through the main opening 50. The connector 34 is accessible through the secondary opening 52 for connecting the connector in fluid communication with a fluid source for inflating the hollow interior 30 (e.g., one or more of the chambers 30*a*, 30*b*, 30*c*). For example, the fluid line from the fluid supply may be inserted through the secondary opening 52 and connected to the connector 34. The main and secondary openings 50, 52 are closed and sealed to shield the bladder 22 from bodily fluid by removing the film strips 60*a*, 60*b* to expose the adhesive provided on the wrap 20 adjacent the openings. The compression garment 10 is applied to the selected body part of the patient. For example, the garment 10 may be wrapped around a limb to be treated and fastened in place using a conventional method. Fluid pressure in the hollow interior 30 is increased to exert a compressive force on the body part. At the end of the compression therapy, the bladder 22 may be removed from the pocket 26 through the main opening 50 by releasing the adhesive seal.

The sealed configuration of the pocket 26 shields the bladder 22 from bodily fluids and/or other potential contaminants sufficiently that the bladder 22 may be reused in another wrap 20 for the same patient or a different patient. Because the bladder 22 is shielded during use, the bladder 22 desirably requires less cleaning or sterilization (e.g., minimal or none) than if the bladder 22 were used in an unsealed pocket. The reusable nature of the bladder 22 decreases the cost associated with compression therapy, and the sealable bladder pocket 26 reduces the potential of spreading disease if the bladder 22 is reused.

Figure 5:
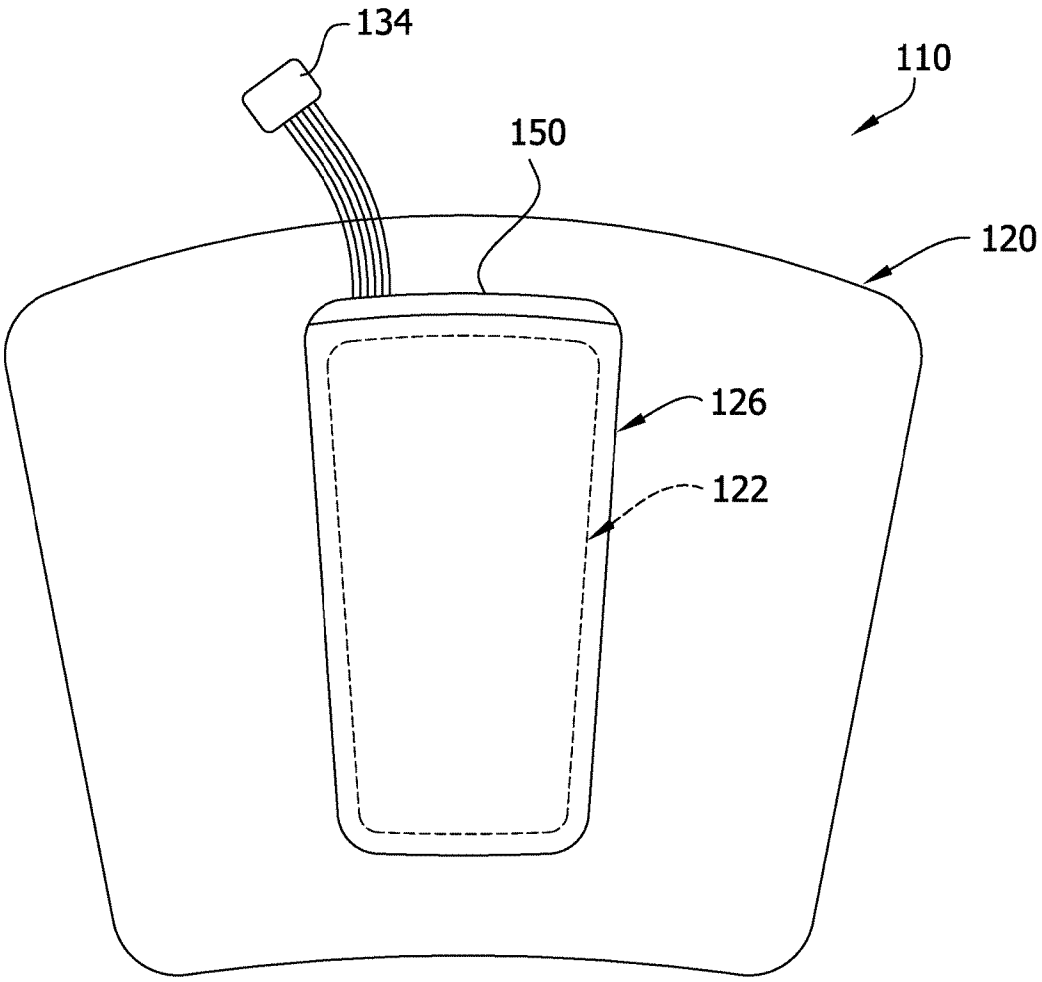
FIG. 5 is a schematic front elevation of a second embodiment of a compression garment of the present invention shown in an open, unwrapped configuration.

FIG. 5 illustrates another embodiment of a compression garment of the present invention which is generally designated in its entirety by the reference number 110. The compression garment is substantially similar to the compression garment 10 described above and corresponding parts are designated by corresponding reference numbers plus 100. For example, the compression garment 110 includes a wrap 120 and a selectively inflatable bladder 122. The wrap 120 also includes a pocket 126. In this embodiment, the pocket 126 includes a main opening 150 but no secondary opening. The main opening 150 is sized for passing the bladder 122 through the opening 150 when inserting the bladder 122 in the pocket 126 and removing the bladder from the pocket. The main opening 150 is configured for permitting the fluid supply line to be operatively connected to the connector 134 on the bladder 122 through the main opening 150 when the bladder is positioned in the pocket 126. The main opening 150 is selectively sealable when closed to hold the bladder 122 in position in the pocket 126 and prevent fluid from entering the pocket through the main opening 150. As with the embodiment described above, the pocket 126 is formed from fluid-impermeable material to shield the bladder 122 from bodily fluids of a patient wearing the compression garment 110.

Figure 6:
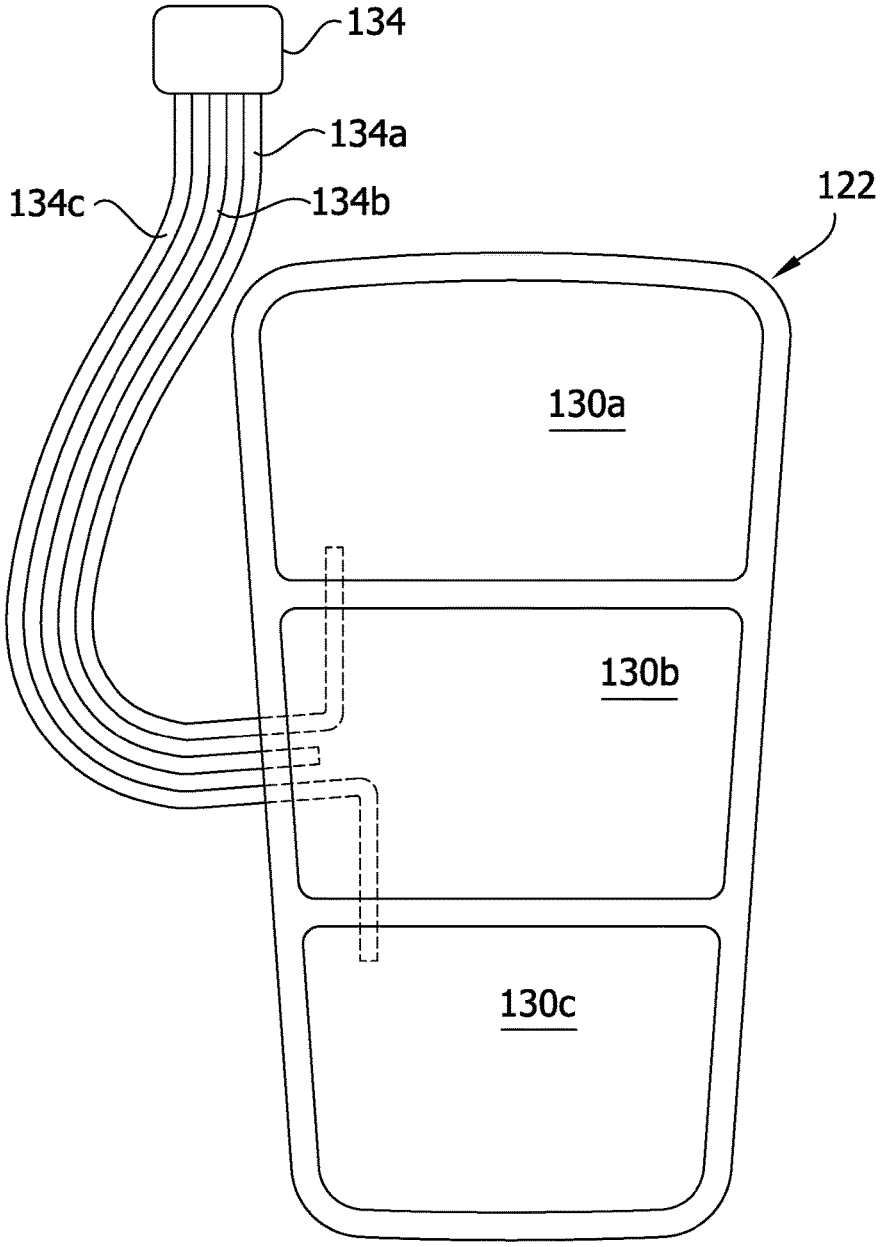
FIG. 6 is a schematic front elevation of a bladder of the compression garment of FIG. 5.

FIG. 6 illustrates the bladder 122 in more detail. The bladder is substantially similar to the bladder 22 described above. For example the bladder includes three inflatable chambers 130*a*-130*c* and a connector 134 in fluid communication with the inflatable chambers via fluid conduits 134*a*-134*c*. In this embodiment, the fluid conduits 134*a*-134*c* are longer such that they pass through the main opening 150 when the bladder 122 is received in the pocket 126 for connecting the bladder to the fluid supply line. The main opening 150 is sealable against the fluid conduits 134*a*-134*c* to prevent bodily fluid from entering the pocket 126 through the main opening. Alternatively, the fluid supply line may be inserted into the pocket 126 and connected to the connector 134 inside the pocket. In such a case, the main opening 150 may be sealed against the fluid supply line to prevent bodily fluid from entering the pocket 126 through the main opening 150.

Figure 7:
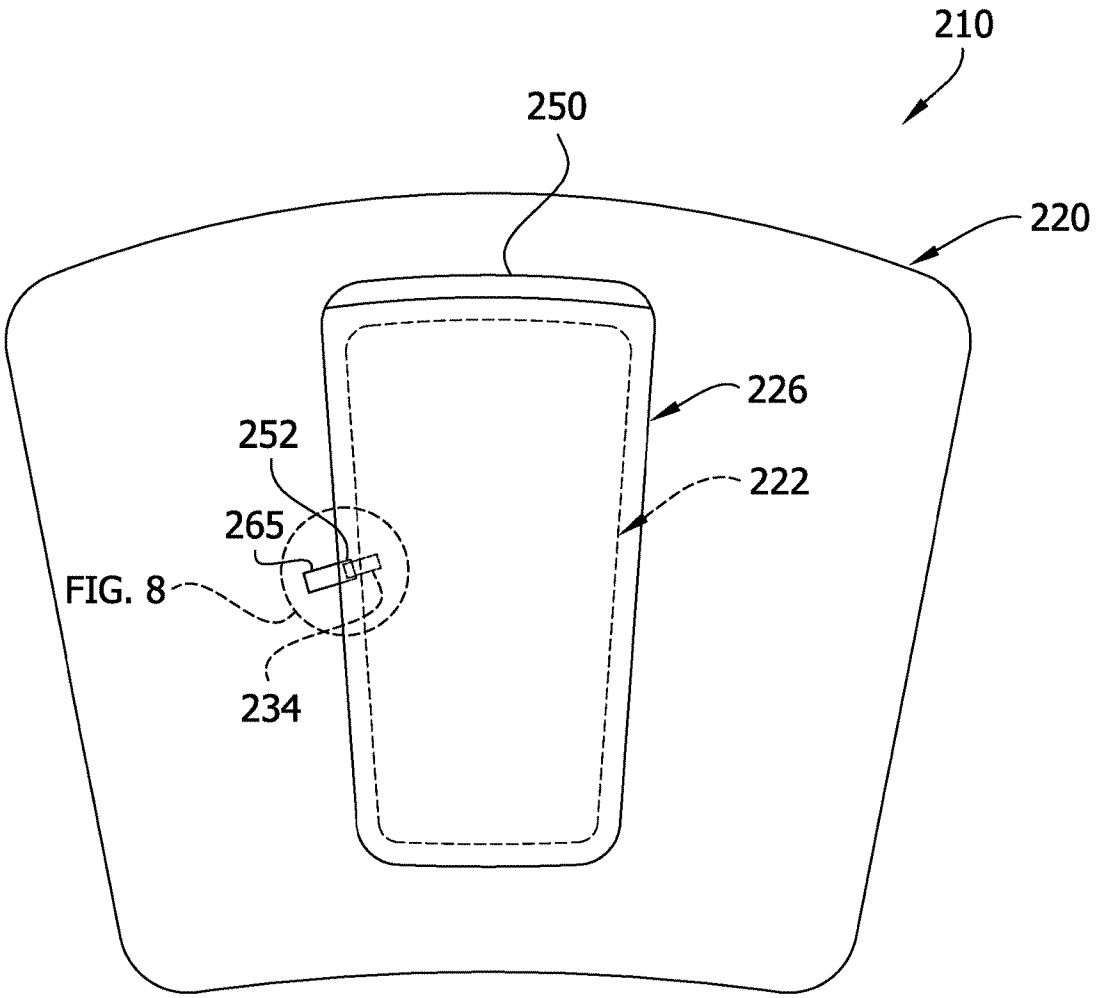
FIG. 7 is a schematic front elevation of a third embodiment of a compression garment of the present invention shown in an open, unwrapped configuration.
Figure 10:
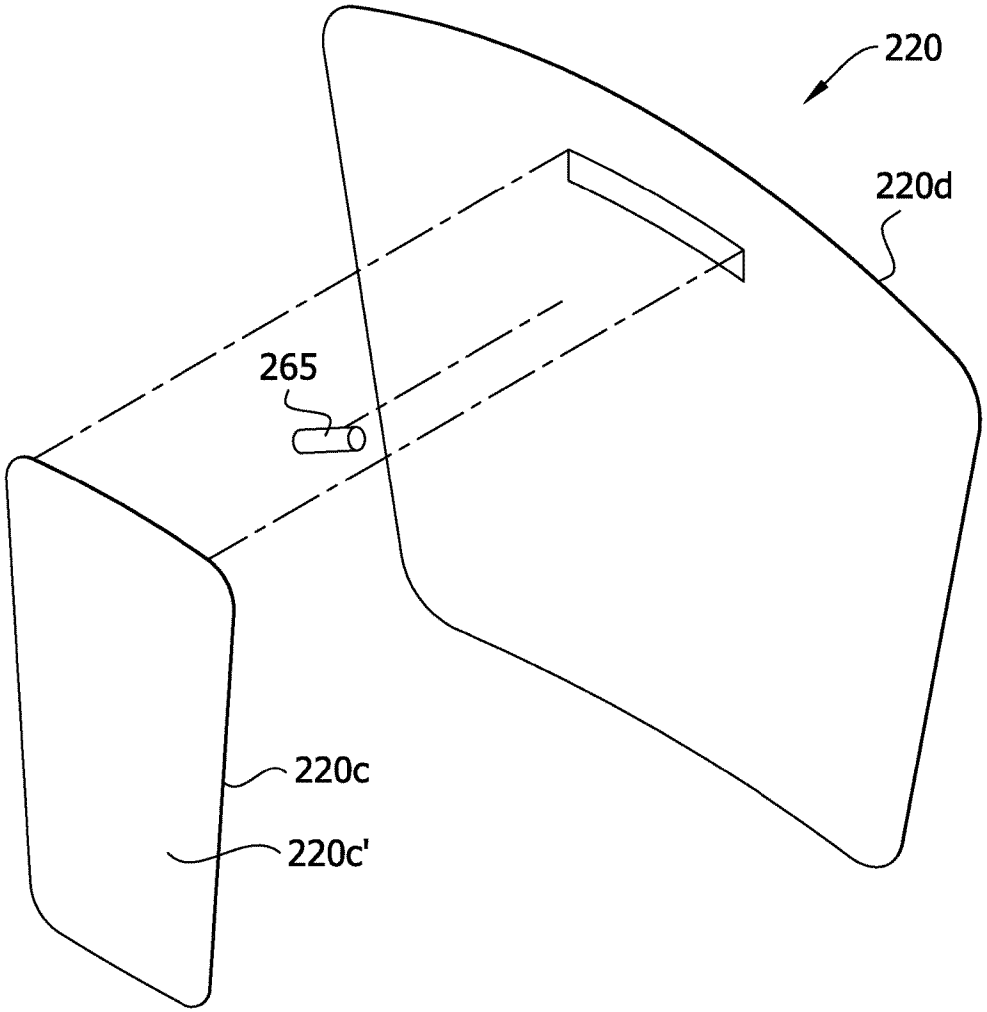
FIG. 10 is a separated perspective of the wrap of the compression garment.

FIG. 7 illustrates another embodiment of a compression garment of the present invention which is generally designated by the reference number 210. The compression garment is substantially similar to the compression garment 10 described above and corresponding parts are designated by corresponding reference numbers plus 200. For example, the compression garment 210 includes a wrap 220 and a selectively inflatable bladder 222. The wrap 220 includes a pocket 226. In this embodiment, a port 265 is positioned in the secondary opening 252 for connecting the connector 234 on the bladder 222 to the supply line. FIG. 10 illustrates a separated view of the wrap 220 including the port 265.

Figure 8:
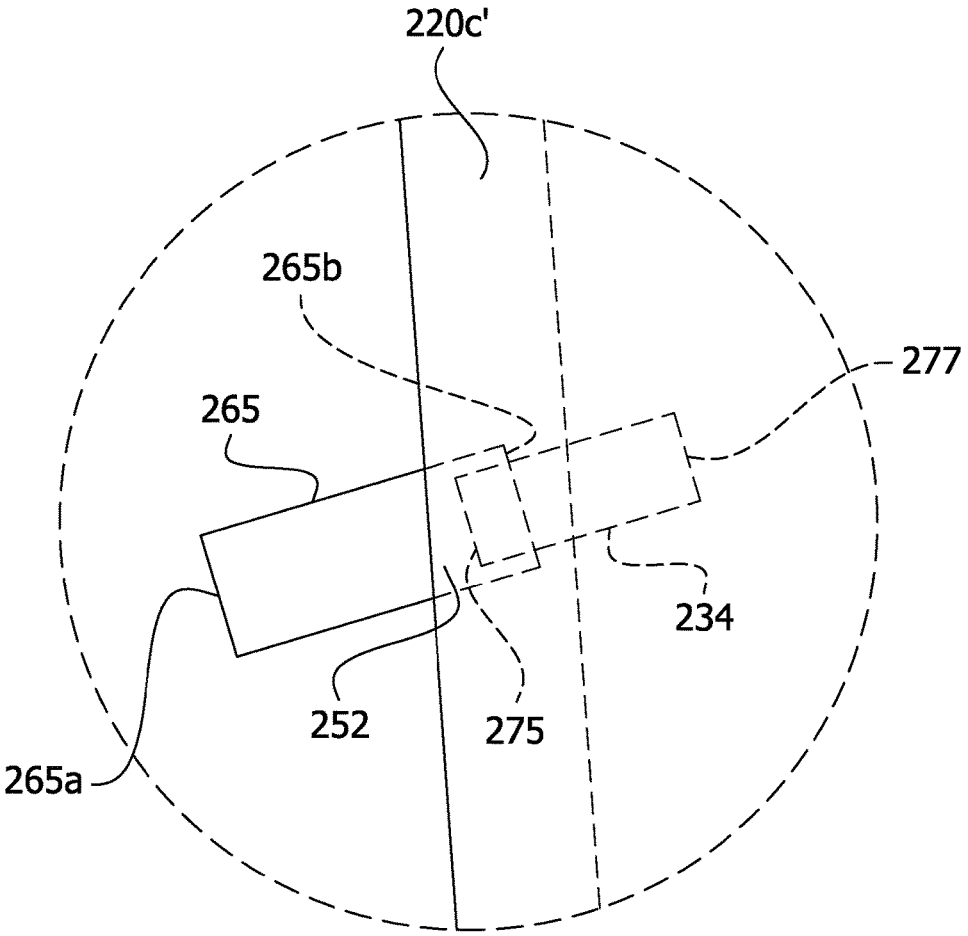
FIG. 8 is an enlarged view of a portion of FIG. 7 showing details of a port arrangement.

As shown in FIG. 8, the port 265 has an inlet 265*a* positioned outside of the pocket 226 adapted to connect to the supply line and an outlet 265*b* positioned inside the pocket adapted to connect to the connector 234 of the bladder 222. During manufacture of the wrap 220, the secondary opening 252 is sealed against an outer surface of the port 265 to prevent bodily fluids from entering the pocket 226 through the secondary opening. The port 265 is positioned between the main body 220*d* and the cover 220*c* of the wrap 220 and bonded to the main body and the cover by the same bond that bonds the main body to the cover. More specifically, the cover boundary bond which bonds a boundary 220*c*' of the cover 220*c* to the main body 220*d* is the same bond that bonds the port 265 to the main body 220*d* and the cover 220*c*.

Figure 9:
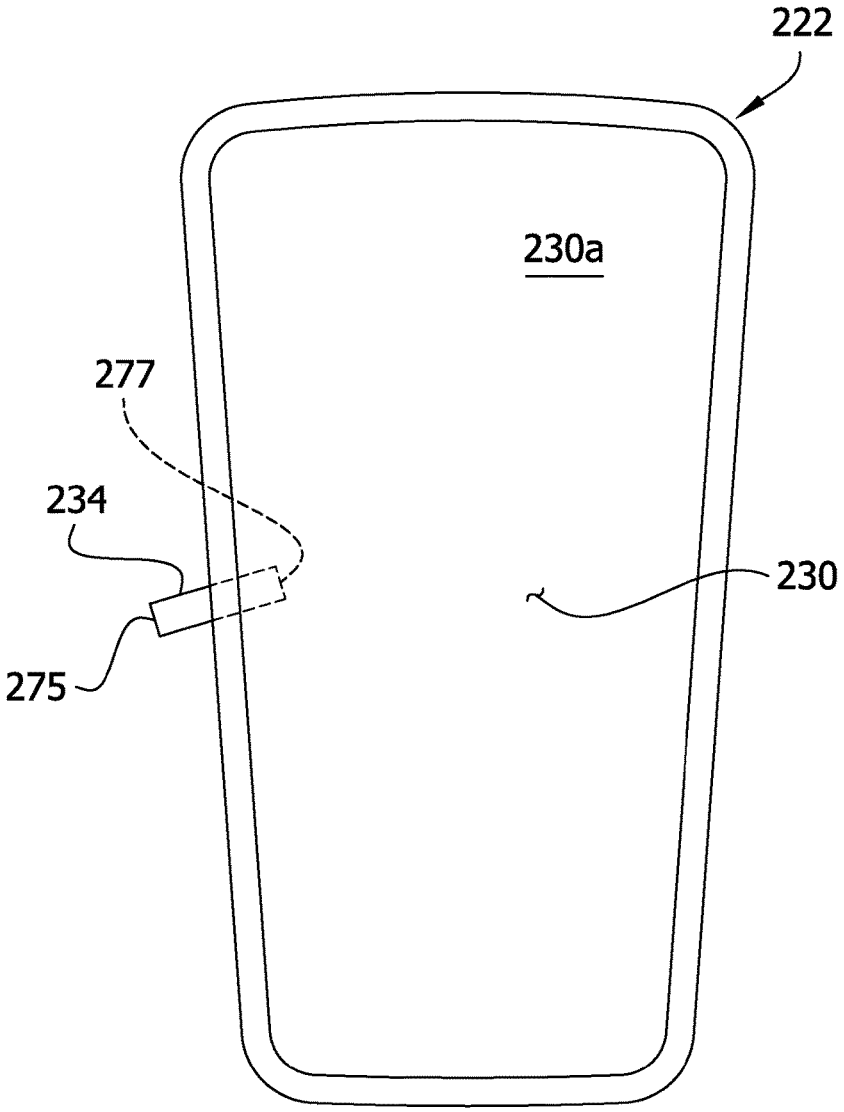
FIG. 9 is a schematic front elevation of a bladder of the compression garment of FIG. 7.

FIG. 9 illustrates the bladder 222 in more detail. In this embodiment, the bladder 222 includes only one inflatable chamber 230*a* and has a connector 234 in direct fluid communication with the inflatable chamber. The connector 234 has an inlet 275 positioned outside the inflatable chamber 230*a* configured to be received in the outlet 265*b* of the port 265 and has an outlet 277 positioned inside the inflatable chamber. When the bladder 222 passes through the main opening 250, the inlet 275 of the connector 234 is received into the outlet 265*b* of the port 265. The connector 234 and the port 265 have corresponding angled orientations for facilitating the connector being received in the port. The fluid supply line is connected to the inlet 265*a* of the port 265 for establishing fluid communication between the supply line and the chamber 230*a*. It is understood the bladder 222 may be modified to include more than one chamber and the connector 234 and port 265 may be modified accordingly to accommodate the multiple chambers.

As is now apparent, in this embodiment only the main opening 250 needs to be sealed after inserting the bladder 222 in the pocket 226 to prevent bodily fluid from entering the pocket during use. As described above, the secondary opening 252 is pre-sealed against the port 265 during manufacture to prevent bodily fluid from entering the pocket 226 through the secondary opening.

When introducing elements of the present invention or the preferred embodiments(s) thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A compression garment adapted for applying compression therapy to a selected body part of a patient, the garment comprising:

a selectively inflatable bladder having a hollow interior and an inlet connector through which fluid passes when entering the interior to inflate the bladder, said connector being connectable to a fluid supply line in communication with a fluid source for supplying fluid to the bladder;

a wrap sized and shaped for wrapping around at least a portion of the selected body part, the wrap including a fastener for fastening the wrap in position when wrapped around the body part and a pocket sized and shaped for receiving the bladder to hold the bladder against the body part when applying compression therapy, the pocket comprising a cover welded to the wrap along three sides of the cover, the pocket having a main opening along a fourth side of the cover sized for passing the bladder therethrough when inserting the bladder in the pocket and removing the bladder from the pocket;

adhesive on at least one of the cover and the wrap adjacent the fourth side of the cover for selectively sealing the main opening with a fluid-tight seal by adhering the cover to the wrap after the bladder is inserted in the pocket to hold the bladder in position in the pocket and prevent fluid from entering the pocket through the main opening; and a secondary opening in the pocket and a port positioned in the secondary opening for fluidly connecting the inlet connector of the bladder to the supply line, the port having an inlet positioned outside of the pocket adapted for fluid connection with the supply line and an outlet positioned inside the pocket adapted for fluid connection with the connector on the bladder;

wherein the bladder is reusable; and wherein the pocket has a sealed configuration when the fourth side of the cover is selectively sealed; and where the sealed configuration of the pocket shields the bladder from fluids.

2. The garment as set forth in claim 1, wherein the wrap and cover are formed from fluid-impermeable material to shield the bladder from bodily fluids of the patient.

3. A garment as set forth in claim 1, wherein the wrap comprises a main body, the cover overlying and welded to the main body in face-to-face relationship around a cover boundary to define the pocket between the cover and the main body, the main opening being located between the cover and main body along the fourth side of the cover.

4. A garment as set forth in claim 1, further comprising a film covering the adhesive and being selectively removable from the adhesive to expose the adhesive after the bladder is inserted in the pocket for sealing the main opening.

5. The garment as set forth in claim 1 wherein the connector is received in the outlet of the port.

6. A garment as set forth in claim 1, wherein the secondary opening is sealed to an outer surface of the port to prevent bodily fluids from the patient entering the pocket through the secondary opening.

7. A garment as set forth in claim 6, wherein the wrap comprises a main body, the cover overlying and welded to the main body in face-to-face relationship around a cover boundary to define the pocket between the cover and the main body, the port being positioned between the main body and cover and welded to the main body and the cover.

8. A garment as set forth in claim 1, wherein the wrap has an outer perimeter and the cover has an outer perimeter, an entirety of the outer perimeter of the cover being located inward of the outer perimeter of the wrap.

9. A compression garment adapted for applying compression therapy to a selected body part of a patient, the garment comprising:

a selectively inflatable bladder having a hollow interior and an inlet connector through which fluid passes when entering the interior to inflate the bladder, said connector being connectable to a fluid supply line in communication with a fluid source for supplying fluid to the bladder; and a wrap sized and shaped for wrapping around at least a portion of the selected body part, the wrap including a fastener for fastening the wrap in position when wrapped around the body part and a pocket sized and shaped for receiving the bladder to hold the bladder against the body part when applying compression therapy, the pocket having a main opening sized for passing the bladder therethrough when inserting the bladder in the pocket and removing the bladder from the pocket and a secondary opening separated from the main opening sized, shaped, and positioned with respect to the main opening for permitting the supply line to be operatively connected to the connector when the bladder is positioned in the pocket, the main opening being selectively sealable when closed to hold the bladder in position in the pocket and prevent fluid from entering the pocket through the main opening, the pocket being formed from fluid-impermeable material to shield the bladder from the bodily fluids of the patient, the secondary opening being selectively sealable with a fluid-tight seal when closed to seal around the connector and prevent fluid from entering the pocket through the secondary opening; and an elongate port positioned in the secondary opening for fluidly connecting the connector of the bladder to the supply line, the port having an inlet positioned outside of the pocket adapted for fluid connection with the supply line and an outlet positioned inside the pocket adapted for fluid connection with the connector on the bladder, the connector being received only partially through the port when the port is in fluid communication with the connector.

10. A garment as set forth in claim 9, wherein the wrap comprises a main body and a cover overlying the main body and bonded to the main body in face-to-face relationship around a cover boundary to define the pocket between the cover and the main body, the main opening and the secondary opening being located between the cover and main body along corresponding segments of the cover boundary that are not bonded to the main body.

11. A garment as set forth in claim 10, wherein the main body and cover comprise fluid-impermeable non-woven material.

12. A garment as set forth in claim 11, further comprising adhesive on at least one of the cover and the main body adjacent the main opening and the secondary opening for sealing the respective openings by adhering the cover to the main body when the bladder is inserted in the pocket.

13. A garment as set forth in claim 12, further comprising a film covering the adhesive and being selectively removable from the adhesive to expose the adhesive after the bladder is inserted in the pocket for sealing the corresponding opening.

14. A garment as set forth in claim 9, wherein the secondary opening is sealed to an outer surface of the port to prevent bodily fluids from the patient from entering the pocket through the secondary opening.

15. A compression garment adapted for applying compression therapy to a selected body part of a patient, the garment comprising:

a selectively inflatable bladder having a hollow interior divided into plural separate chambers, conduits in fluid communication with a respective one of the chambers, and an inlet connector in fluid communication with each conduit, said connector being connectable to a fluid supply line in communication with a fluid source for supplying fluid to each of the chambers of the bladder through the conduits;

a wrap sized and shaped for wrapping around at least a portion of the selected body part, the wrap including a fastener for fastening the wrap in position when wrapped around the body part and a pocket sized and shaped for receiving the bladder to hold the bladder against the body part when applying compression therapy, the pocket comprising a cover attached to the wrap along three sides of the cover, the pocket having a main opening along a fourth side of the cover sized for passing the bladder therethrough when inserting the bladder in the pocket and removing the bladder from the pocket; and adhesive on at least one of the cover and the wrap adjacent the fourth side of the cover for selectively sealing the main opening with a fluid-tight seal by adhering the cover to the wrap after the bladder is inserted in the pocket to hold the bladder in position in the pocket and prevent fluid from entering the pocket through the main opening; and a secondary opening in the pocket and a port positioned in the secondary opening for fluidly connecting the inlet connector of the bladder to the supply line, the port having an inlet positioned outside of the pocket adapted for fluid connection with the supply line and an outlet positioned inside the pocket adapted for fluid connection with the connector on the bladder;

wherein the pocket has a sealed configuration when the fourth side of the cover is selectively sealed; and where the sealed configuration of the pocket shields the bladder from fluids.

* * * * *